US005745086A

United States Patent [19]

Weber

[11] Patent Number: 5,745,086

[45] Date of Patent: Apr. 28, 1998

[54] PLASMA PANEL EXHIBITING ENHANCED CONTRAST

[75] Inventor: Larry F. Weber, New Paltz, N.Y.

[73] Assignee: Plasmaco Inc., Highland, N.Y.

[21] Appl. No.: 564,926

[22] Filed: Nov. 29, 1995

[51] Int. Cl.[6] ..... G09G 3/28; G09G 3/10

[52] U.S. Cl. ..... 345/63; 315/169.4

[58] Field of Search ..... 345/60, 62, 63, 345/67, 68, 69, 204, 208, 66; 315/169.4

[56] References Cited

U.S. PATENT DOCUMENTS

| | | | |
|---|---|---|---|
| 3,727,102 | 4/1973 | Johnson . | |
| 4,063,131 | 12/1977 | Miller | 345/68 |
| 4,087,805 | 5/1978 | Miller | 345/208 |
| 4,087,807 | 5/1978 | Miavecz | 345/68 |
| 4,130,779 | 12/1978 | Millen et al. | 345/208 |
| 4,140,945 | 2/1979 | Trogdon | 345/63 |
| 4,492,957 | 1/1985 | Marentic | 345/69 |
| 4,550,274 | 10/1985 | Weber | 345/60 |
| 4,611,203 | 9/1986 | Criscimagna et al. . | |
| 4,683,470 | 7/1987 | Criscimagna et al. | 345/68 |
| 4,772,884 | 9/1988 | Weber et al. | 345/67 |
| 4,866,349 | 9/1989 | Weber et al. . | |
| 5,081,400 | 1/1992 | Weber et al. . | |
| 5,142,200 | 8/1992 | Yamamoto et al. | 345/68 |

FOREIGN PATENT DOCUMENTS

0549275A1 6/1993 European Pat. Off. .

OTHER PUBLICATIONS

IEEE Transactions on Electron Devices, vol. ED-33, No. 8, Aug. 1986—Larry F. Weber, et al. — 'Quantitative Wall Voltage Characteristics of AC Plasma Displays' (pp. 1159–1168).

IEEE Transactions on Electron Devices, vol. ED-28, No. 6, Jun. 1981 — Tony N. Criscimagna, et al. — 'Write and Erase Waveforms for High-Resolution AC Plasma Display Panels' (pp. 630–638).

Japan Display '92 — K. Yoshikawa, et al. — 'A Full Color AC Plasma Display with 256 Gray Scale' (pp. 605–608).

SID 93 Digest — T. Shinoda, et al. — 'Development of Technologies for Large-Area Color ac Plasma Displays' (pp. 161–164).

*Primary Examiner*—Steven Saras
*Assistant Examiner*—Paul A. Bell
*Attorney, Agent, or Firm*—Ohlandt, Greeley, Ruggiero & Perle

[57] ABSTRACT

A plasma panel, incorporating the invention, includes circuitry for applying row signals sequentially to a plurality of row electrodes. Each row signal includes a set-up period, an address period and a sustain period. A row signal during the set-up period includes both a positive-going ramp voltage and a negative-going ramp voltage, both ramp voltages causing a discharge of each pixel site along an associated row electrode. Both ramp voltages exhibit a slope that is set to assure that current flow through each pixel site remains in a positive resistance region of the gas's discharge characteristic, thus assuring a relatively constant voltage drop across the discharging gas, thus resulting in predictable wall voltage states. The set-up period thereby creates standardized wall potentials at each pixel site along each row electrode. Address circuitry applies, during the address period, data pulses to a plurality of column electrodes to enable selective discharge of the pixel sites in accordance with data pulses and in synchronism with the row signals.

12 Claims, 8 Drawing Sheets

DRIVING WAVEFORM

PLASMA PANEL EXHIBITING ENHANCED CONTRAST

FIELD OF THE INVENTION

This invention relates to a method and apparatus for assuring standardized wall charge states and providing improved image contrast during operation of a full color AC plasma display panel and, more particularly, to an improved low voltage driver circuit which, during a set-up phase, establishes standardized wall charge states while emitting a minimum of background light.

BACKGROUND OF THE INVENTION

Plasma display panels, or gas discharge panels, are well known in the art and, in general, comprise a structure including a pair of substrates respectively supporting column and row electrodes, each coated with a dielectric layer and disposed in parallel spaced relation to define a gap therebetween in which an ionizable gas is sealed. The substrates are arranged such that the electrodes are disposed in orthogonal relation to each other, thereby defining points of intersection which, in turn, define discharge pixel sites at which selective discharges may be established to provide a desired storage or display function.

It is known to operate such panels with AC voltages and particularly to provide a write voltage which exceeds the firing voltage at a given discharge site, as defined by selected column and row electrodes, thereby to produce a discharge at a selected cell. The discharge can be continuously "sustained" by applying an alternating sustain voltage (which, by itself, is insufficient to initiate a discharge). The technique relies upon wall charges generated on the dielectric layers of the substrates which, in conjunction with the sustain voltage, operate to maintain continuing discharges.

In order for an AC plasma panel to exhibit reliable operation, its wall charge states must be repeatable and standardized. More specifically, the wall charge states must exhibit repeatable values irrespective of a previous data storage state so that succeeding address and sustain signals reliably cooperate to assure repeatable pixel site operation. It is known that wall voltages in certain color AC plasma panel displays tend to exhibit substantial variance over the period of operation of a panel.

In order to standardize such wall voltage states, the prior art has suggested that, prior to an address period wherein each pixel in a row is addressed in accordance with input data, that the address phase be preceded by an entire screen erase operation, followed by an entire screen write, followed by an entire screen erase. Such a procedure is described by Yoshikawa, et al. in "A Full Color AC Plasma Display With 256 Gray Scale," Japan Display, '92, pages 605–608.

To understand the procedure suggested by Yoshikawa et al., reference should first be made to FIG. 1 hereof wherein the structure of a four color AC plasma panel is schematically illustrated. Plasma panel 10 includes a back substrate 12 upon which plural column address electrodes 14 are supported. Column address electrodes 14 are separated by barrier ribs 16 and are covered by red, green and blue phosphors 18, 20 and 22, respectively. A front transparent substrate 24 includes a pair of sustain electrodes 26 and 28 for each row of pixel sites. A dielectric layer 30 is emplaced on front substrate 24 and a magnesium oxide overcoat layer covers the entire lower surface thereof, including all of sustain electrodes 26 and 28.

The structure of FIG. 1 is sometimes called a single substrate AC plasma display since both sustain electrodes 26 and 28, for each row, are on a single substrate of the panel. An inert gas mixture is positioned between substrates 12 and 24 and is excited to a discharge state by sustain voltages applied by sustain electrodes 26 and 28. The discharging inert gas produces ultra-violet light that excites the red, green and blue phosphor layers 18, 20 and 22, respectively to emit visible light. If the driving voltages applied to column address electrodes 14 and sustain electrodes 26, 28 are appropriately controlled, a full color image is visible through front substrate 24.

In order to cause the AC plasma panel of FIG. 1 to exhibit a full color image for applications such as television or computer display terminals, a means of achieving a gray scale is needed. Since it is desirable to operate AC plasma panels in the memory mode to achieve high luminance and low flicker, a special addressing technique has been suggested by Yoshikawa, et al. to achieve gray scale in pixels that only exist in the ON or OFF states.

In FIG. 2, the driving sequence used by Yoshikawa, et al. to achieve a 256 grey scale is illustrated. The drive sequence is sometimes called the sub-field addressing method. The plasma display panel is addressed in a conventional video manner which divides images into frames. A typical video image may be presented at 60 frames per second, which corresponds to a frame time of 16.6 milliseconds (see FIG. 2). The sub-field addressing method shown in FIG. 2 divides each frame into 8 sub-fields (SF1–SF8). Each of the 8 sub-fields is further divided into an address period and a sustain period (see FIG. 3 wherein a representative sub-field wave form chart is illustrated). During the sustain period, a sustain voltage is applied to sustain electrodes 26 and 28. Thus, if a given pixel site is in the ON state, it is caused to emit light by the sustain pulses. By contrast, the sustain voltage is insufficient to cause a discharge at any pixel site that is in the OFF state.

Note in FIG. 2 that the length of the sustain period of each of the 8 sub-fields is different. The first sub-field has a sustain period with only 1 complete sustain cycle period. The second sub-field has 2 sustain cycles, the third sub-field has a sustain period with 4 sustain cycles and, so forth, until the 8th sub-field which has a sustain period with 128 sustain cycles.

By controlling the addressing of a given pixel site during the addressing period, the perceived intensity of the pixel site can be varied to any one of the 256 gray scale levels. Suppose it is desired for a selected pixel site to emit at half-intensity or at level 128 out of 256. In such a case, a selective write address pulse is applied to the pixel site during sub-field 8 by applying an appropriate voltage to a column address electrode 14 (and utilizing one of sustain lines 26/28 as the opposing address conductor). No address pulses are applied during the other sub-fields to the addressed pixel site. This means that during the first 7 sub-fields, there is no writing action and therefore no light is emitted during the sustain periods. However, for sub-field 8, the selective write action turns ON the selected pixel site and causes an emission of light therefrom during the sub-field 8 sustain period (in this case for 128 sustain cycles). The 128 sustain cycle per frame energization corresponds to a half-intensity for a frame time.

If, alternatively, it is desired for the selected pixel site to emit at one-quarter intensity or at level 64 out of 256, then a selective write address pulse is applied to the pixel site during sub-field 7 and no address pulses are applied during the other sub-fields. Thus, during sub-fields 1, 2, 3, 4, 5, 6 and 8, there is no writing and therefore no light is emitted during the respective sustain periods. However, for sub-field 7, the selective write turns ON the selected pixel site and causes an emission of light during the sub-field sustain period (in this case, for 64 sustain cycles corresponding to a 1-quarter intensity). For a full-intensity case, the selective write address pulse is applied during all 8 sub-fields so that the pixel site emits light for all sustain periods for each of the 8 sub-fields—corresponding to a full-intensity for the frame.

The Yoshikawa et al. procedure enables any of 256 different intensities to be achieved through the action of a display processor supplying an 8 bit data word for each sub-pixel site, the data word corresponding to the desired gray intensity level. By routing each of the bits of the data word to control the selective write pulse of each of the 8 address periods of the 8 sub-fields in a given frame, the 8 bit data word controls the number of sustain cycles during which the selected pixel site will emit light for that frame. Thus, any integer number of sustain cycles per frame between and including 0–255 is obtainable.

In order to modify the data stored in the plasma panel structure shown in FIG. 1, Yoshikawa, et al. apply, during an address period (see FIG. 3), write pulses to selected pixel sites. The selective write pulses consist of sequentially scanned, negatively-going pulses applied to one of sustain electrodes 26/28 (which acts as a row address electrode), in conjunction with application of the selective address data to the pixel sites by means of positive-going address pulses applied to column address electrodes 14. During a given address period of a given sub-field, every pixel site in the panel has the potential of being written by a write pulse. During this address period, each of the rows of pixel sites in the panel is sequentially scanned, one at a time by negative-going pulses, using a normal raster-scan technique. As indicated above, the negative-going pulses are applied to one of the sustain electrodes 26/28 which is designated as the address sustain line. The non-addressed sustain line does not receive this negative-going address pulse.

If a given pixel site is to be placed in the ON state to emit light during a given sub-field sustain period, then when the address sustain electrode is pulsed negative during the address period sequential scan, a positive pulse is applied to the intercepting column address electrode 14. If the given pixel site is to be placed in the OFF state to emit no light during a given sub-field sustain, then, when the addressed sustain electrode is pulsed negative during the address period sequential scan, no positive pulse is applied to the intersecting rear substrate address electrode 14. In this manner, the state and perceived intensity of all pixels in the panel are controlled by the presence or absence of positive going pulses applied to the rear substrate column address electrodes 14.

An initial portion of the Yoshikawa, et al. address period is utilized to overcome the wall charge variability problem mentioned above. The initial portion of the address period may be termed a "set up" period wherein certain operations are performed to assure proper subsequent operation of the panel. The set up period must serve to prime the pixel sites so as to provide reliable starting of discharge actions during the selective address period and the following sustain period. Priming is especially important for pixel sites that do not discharge very frequently, such as those that are initially in the lowest intensity or in the OFF state. The set up period must also reliably establish appropriate fixed levels of wall voltages in all pixel sites for a given sub-field operation. This fixed level of wall voltage is determined by the needs of the selective write operation during the address period of each sub-field. It is critical that this fixed level of wall voltage for a given sub-field not be dependent on the level of wall voltages remaining from a previous sub-field action. If the latter is the case, a variability will result in the level of the wall voltage that is dependent on the state of the previous sub-field. This may cause a total miss-addressing during the selective write operation.

To achieve the desired wall voltage-state, Yoshikawa, et al. employ a bulk-write operation position between two bulk erase operations. The bulk write operation is achieved by a high-voltage pulse that causes every sub-pixel in the entire panel to discharge and places the wall voltages thereof into a known state. The bulk write action also serves to prime all sub-pixels. Unfortunately, such large voltage pulses have the undesirable characteristic of generating a very significant amount of discharge light during the set up period. This discharge light has the effect of significantly reducing the dark room contrast ratio of the panel.

The dark room contrast ratio is determined by the ratio of the luminance of pixel sites in the full intensity state to the luminance of pixel sites in the OFF state. The full intensity luminance is determined by the characteristics of the panel's design and the sustain frequency. The full intensity luminance is not determined by the characteristics of the set-up period. However, the off-state luminance is determined almost entirely by the panel's operation during the set-up period. This is due to the fact that an off-pixel site, by definition, does not have a selective write operation during the address period and also does not have any sustain discharges during the sustain period. The only discharges that the OFF pixel site experiences are the priming and set-up discharges that occur during the set-up period. As above-indicated, application of the bulk erase/bulk write/bulk erase action creates substantial light emission which serve to impair the contrast ratio of the panel.

It has been determined, notwithstanding the teaching of Yoshikawa et al., that a bulk erase/bulk write/bulk erase set-up action may not achieve standardized wall charge states.

Accordingly, it is an object of this invention to provide an improved method and apparatus for assuring standardized wall charge states in an AC plasma panel.

It is another object of this invention to provide a full-color AC plasma panel which exhibits improved contrast.

It is yet another object of this invention to provide an improved, full-color AC plasma panel which employs low voltage driving circuitry, while achieving standardized wall charge states and improved contrast.

SUMMARY OF THE INVENTION

A plasma panel, incorporating the invention, includes circuitry for applying row signals sequentially to a plurality of row electrodes. Each row signal includes a set-up period, an address period and a sustain period. A row signal during the set-up period includes both a positive-going ramp voltage and a negative-going ramp voltage, both ramp voltages causing a discharge of each pixel site along an associated row electrode. Both ramp voltages exhibit a slope that is set to assure that current flow through each pixel site remains in a positive resistance region of the gas's discharge characteristic, thus assuring a relatively constant voltage drop across the discharging gas, thus resulting in predictable wall voltage states. The set-up period thereby creates standardized wall potentials at each pixel site along each row electrode. Address circuitry applies, during the address period, data pulses to a plurality of column electrodes to enable selective discharge of the pixel sites in accordance with data pulses and in synchronism with the row signals.

DETAILED DESCRIPTION OF THE INVENTION

In order to understand the reason why the Yoshikawa, et al. bulk erase/bulk write/bulk erase procedure may not assure standardized wall voltage states, it is useful to understand wall voltage input-output curves that are used to characterize plasma display pixel electrical characteristics. An inventor hereof (i.e. L. F. Weber) and others have published an article entitled "Quantitative Wall Voltage Characteristics of AC Plasma Displays," IEEE Transactions on Electron Devices, Vol. ED-33, No. 8, August 1986, pages 1159–1168, wherein wall voltage input-output (WVIO) curves are shown and their utility in understanding plasma panel operations are described.

Figure 4:
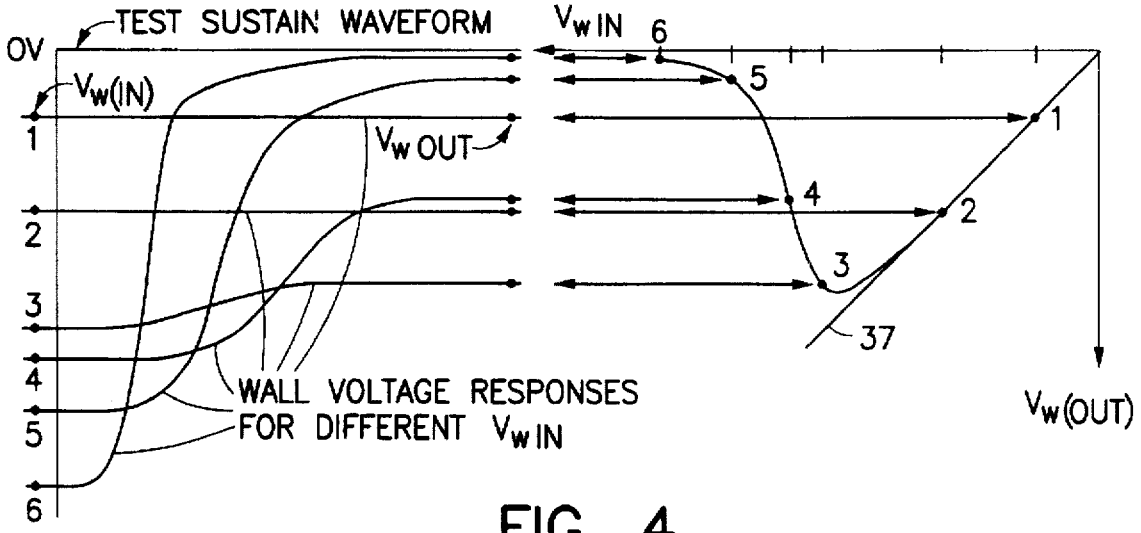
FIG. 4 PRIOR ART
FIG. 4 is a prior art plot of wall voltage output values in response to a test sustain wave form, for various input wall voltage states.

The WVIO curve describes how a given AC plasma pixel site will respond to a given applied sustain pulse of some arbitrary shape or timing. FIG. 4 illustrates an exemplary set of WVIO curves. The horizontal axis of the WVIO curve corresponds to the input wall voltage before an applied sustain pulse. The vertical axis of the WVIO curve corresponds to the output wall voltage after the discharge (or lack of discharge) caused by an applied sustain pulse. The left side of the FIG. 4 shows a simple square-wave test sustain waveform and the wall voltage responses which result therefrom.

A given pixel site can have a different WVIO curve for each differing shape or timing of a an applied sustain pulse. It has been determined that color AC plasma displays have dramatically different WVIO curves than do monochrome AC plasma displays and thus, the results shown in FIG. 4 cannot be used to predict a color AC plasma display action. Wall voltages of color pixel sites in a color AC plasma display are much more difficult to control than wall voltages of monochrome pixel sites.

The right-most slope region of the WVIO curve of FIG.4 (falling along slope "one" line 37 which intersects 0 volts and points 1 and 2), corresponds to the region where the input wall voltage equals the output wall voltage, meaning that no discharge occurs during the sustain pulse. As the input wall voltage Vw(in) becomes sufficiently negative, at some point the voltage across the ionizable gas becomes sufficiently large to cause a discharge of the gas and the output wall voltage Vw(out) moves upward—as demonstrated at points 3, 4 and 5 in FIG. 4. At a sufficiently large negative input voltage, the discharge is very intense, the voltage across the gas is nearly reduced to 0 and the output voltage goes to a constant level near 0, independent of the value of the input voltage. This activity corresponds to point 6 on the WVIO curve of FIG. 4.

Figure 1:
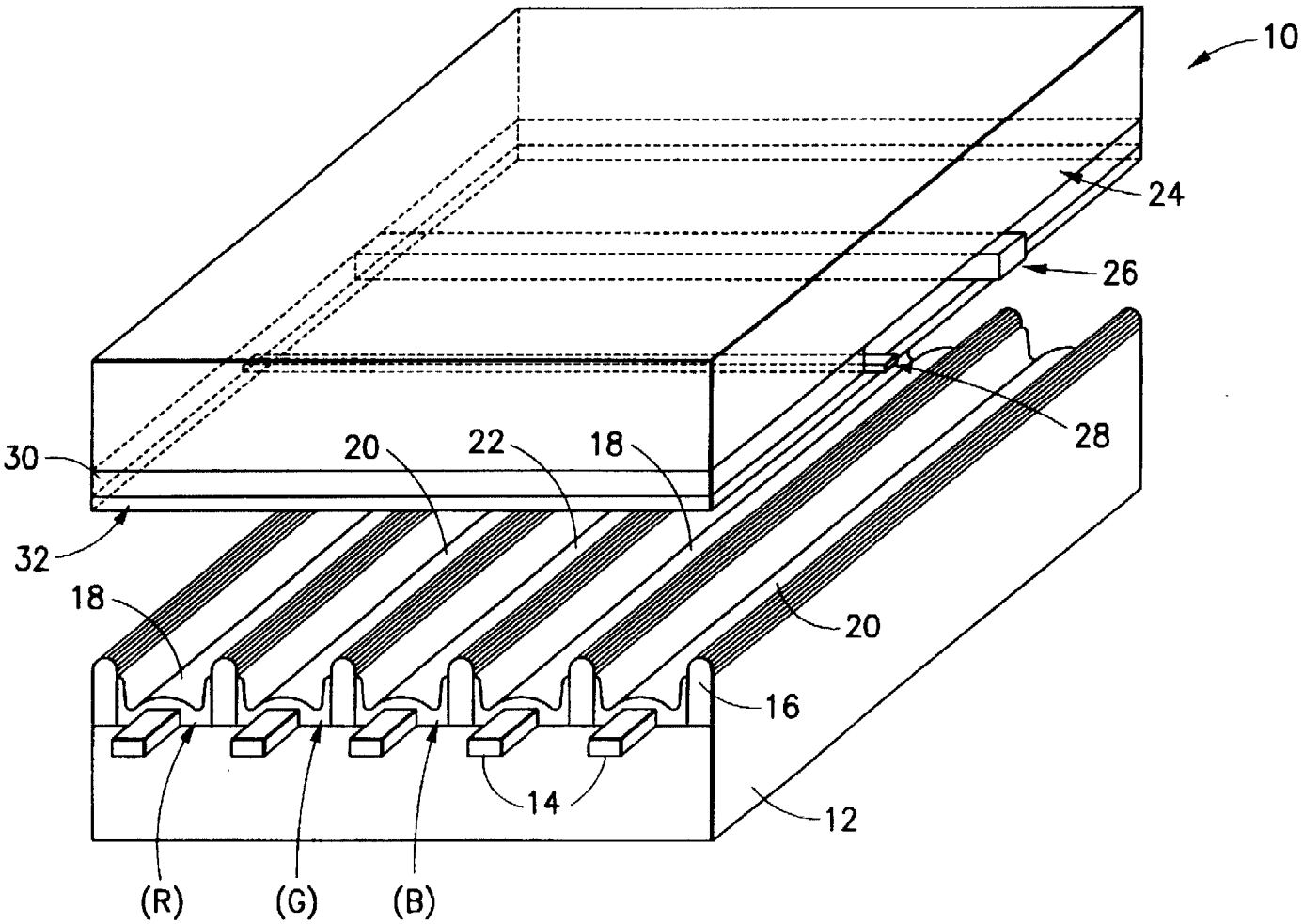
FIG. 1 PRIOR ART
FIG. 1 is a perspective view of a prior art full-color AC plasma panel display structure.
Figure 2:
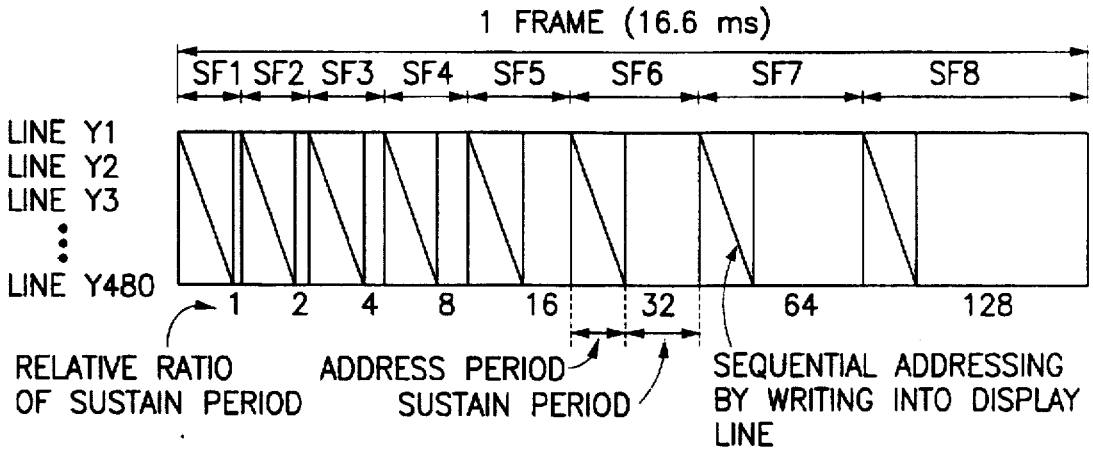
FIG. 2 PRIOR ART
FIG. 2 is a diagram illustrating a prior art method for actuating an AC plasma panel utilizing 8 sub-frames to achieve variable grey scale levels.
Figure 3:
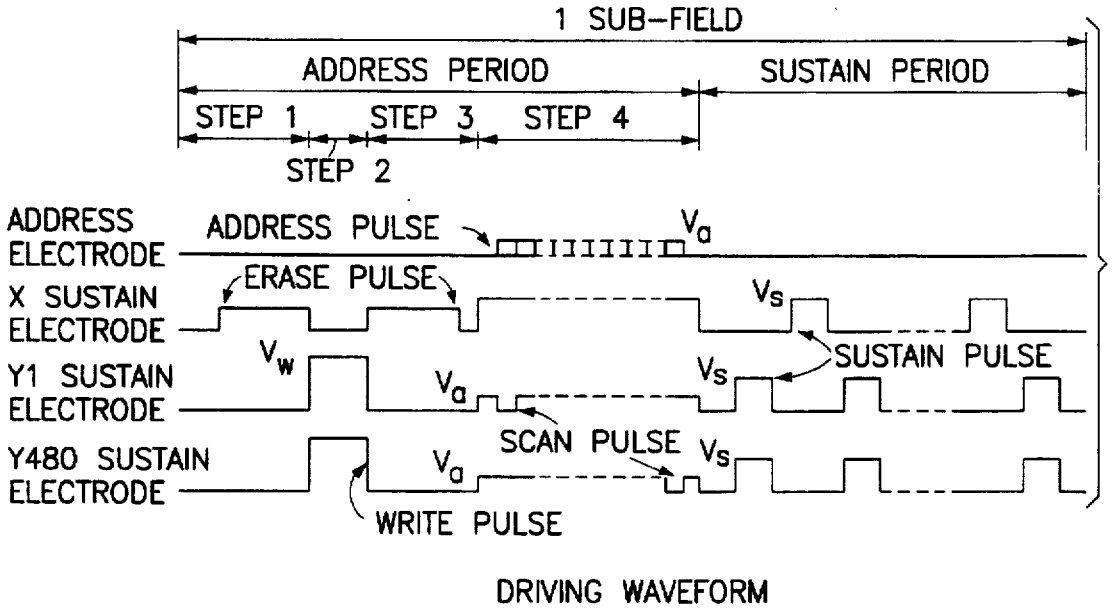
FIG. 3 PRIOR ART
FIG. 3 is a waveform diagram illustrating wave shapes employed during a single sub-field illustrated in FIG. 2.
Figure 5:
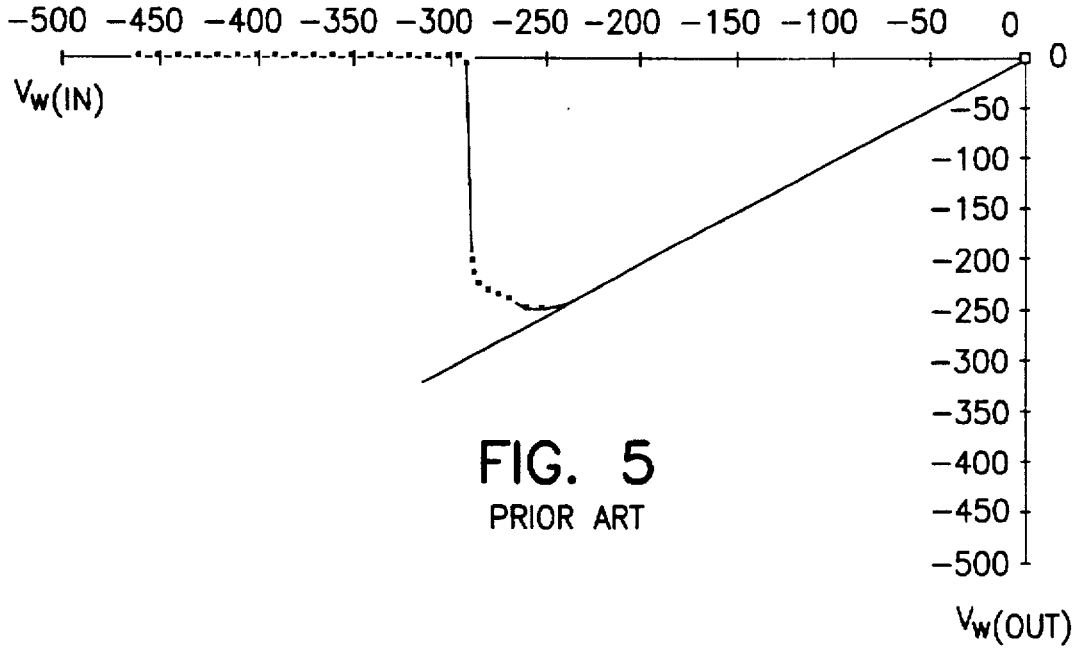
FIG. 5 PRIOR ART
FIG. 5 is a plot of wall voltage output values in response to an infinitely fast rise time sustain pulse.

FIG. 5 shows a typical WVIO curve, measured for a typical color plasma display pixel site, such as that shown in FIG. 1. It is instructive to compare FIGS. 4 and 5. The color pixel site shows the same initial slope one characteristic of the monochrome pixel site for input wall voltages where there is no discharge. However, when the input wall voltage approaches the level where a discharge occurs, the wall voltage changes dramatically with a very strong discharge and the voltage across the gas quickly goes to 0. Any further decrease of input wall voltage below this discharge wall voltage threshold still causes the voltage across the gas, after discharge, to go to 0 and produces a near 0 output voltage for all further decreases of input wall voltages.

Note further that the region between points 3 an 6 in FIG. 4 are substantially rounded, whereas the identical portion of the curve of FIG. 5 has a very sharp vertical rise in the same region. This very sharp discharge threshold and the fast discharge characteristics of the color pixel sites make the color pixels much harder to control.

While the applied sustain waveforms illustrated in FIGS. 4 and 5 have negligible rise times, it is not possible to generate infinitely fast rise time waveforms, in practice. Practical rise times of several hundred nanoseconds are typically applied in practical systems. Under proper operation, the finite rise time of an applied sustain pulse does not significantly change the characteristics of the WVIO curve. It has been determined that the latter is true so long as the major portion of the discharge does not occur during the rising portion of the applied sustain waveform. If a significant amount of the discharge does occur during the rise of the sustain waveform, then the strength of the discharge is usually weaker and the output wall voltage does not go to the same high level that it might have, had the discharge occurred after the sustain voltage had risen to its full level.

As indicated above, an ideal set-up period establishes the same output wall voltage for all possible input wall voltage states that might have occurred before the set-up period waveforms. The large horizontal region on the left-most region of the waveform of FIG. 5 appears to be ideally suited for the set-up period requirements since the output wall voltage Vw(out) remains at a constant 0 volts over a wide range of input wall voltages Vw(in)—i.e., between −290 and −500 volts. This characteristic occurs, however, only for an ideal infinitely fast rise time sustain waveform.

Figure 6:
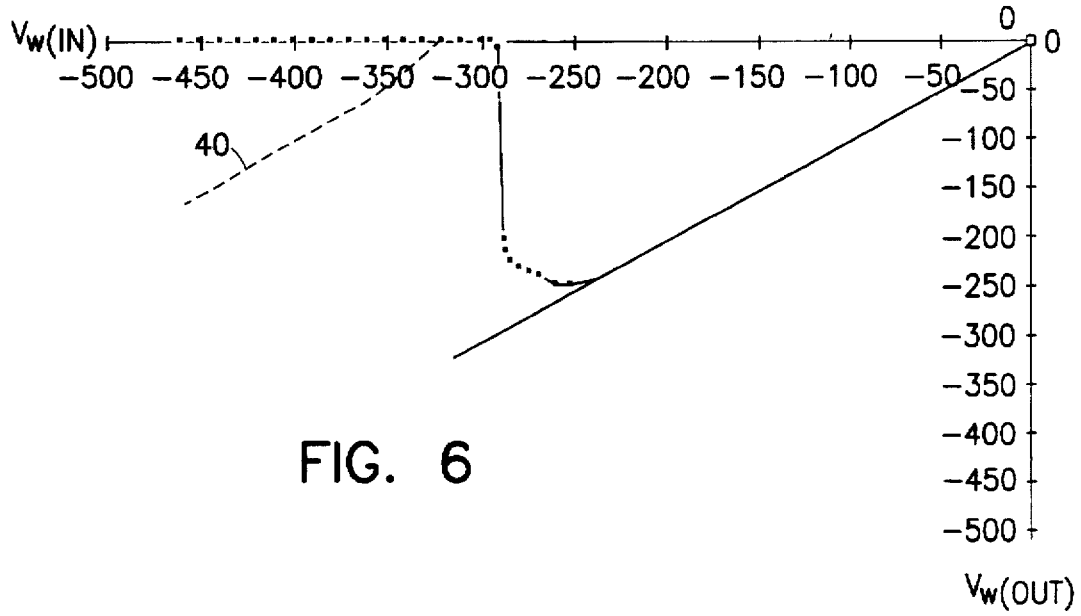
FIG. 6 is a plot of wall voltage output values in response to a finite rise time sustain pulse.

FIG. 6 shows a color pixel WVIO curve for a sustain waveform with a more practical finite rise time. As the input wall voltage is reduced, at some level, a sharp discharge occurs and the voltage across the gas is reduced to 0. When, however, the discharge occurs on the slope of the sustain waveform, the output wall voltage does not go to 0 level shown by the plotted squares in FIG. 6, but rather goes to some lower level, as indicated by the dashed negative slope plot 40. Plot 40 indicates that the output wall voltage varies considerably over a range of input wall voltage states.

There is only small region where the WVIO curve of FIG. 6 is horizontal (i.e. between VW(in)=−290 volts and −325 volts) . The exact position of that region, of course, varies from pixel site to pixel site and is therefore not practically usable for reliable display panel operation.

It has been determined that a very slowly rising or very slowly falling applied sustain waveform will produce a controllable WVIO characteristic with a wide horizontal region, where output wall voltage is relatively constant for a wide range of input wall voltages.

Figure 7:
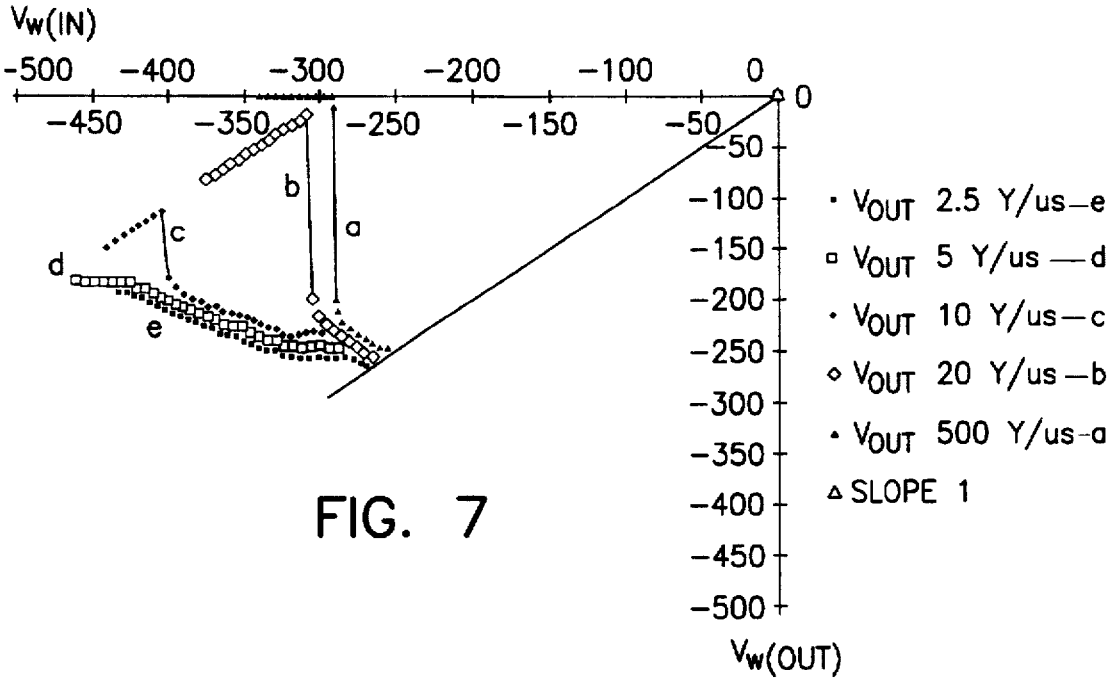
FIG. 7 is a plot of wall voltage output values in response to varying slope rise time sustain pulses.

FIG. 7 is a plot of the WVIO curve of a color pixel site illustrating behavior of the output wall voltage state with applied sustain waveforms having different slope values. Five different rise times (labelled a,b,c,d and e) are shown in the FIG. 7. Note that for rise times a,b and c (500 volts/microsec., 20 volts/microsec., and 10 volts/microsec., respectively), that a sharp threshold characteristic is exhibited that is not suited for establishment of a standardized wall charge state. However, when the sustain waveform rise time is slowed (i.e. to less than 10 volts/microsec.), the WVIO curves enter a region where, no matter what the input wall voltage, there is relatively little change in output wall voltage. Note that the WVIO curves for rise times d and e (5 volts/microsec. and 2.5 volts/microsec., respectively) give virtually the same WVIO curve.

It has been observed that, beyond some limit in rise time, the slow rise times do not show any substantial difference in the WVIO characteristic. While the slower rise time does exhibit an increased amount of time that the slow waveform takes, a very constant level of wall voltage is the result. Note also that, for the very large negative values of VW(in), the Vw(out) values show a horizontal region where there is little or no change in Vw(out).

Figure 8:
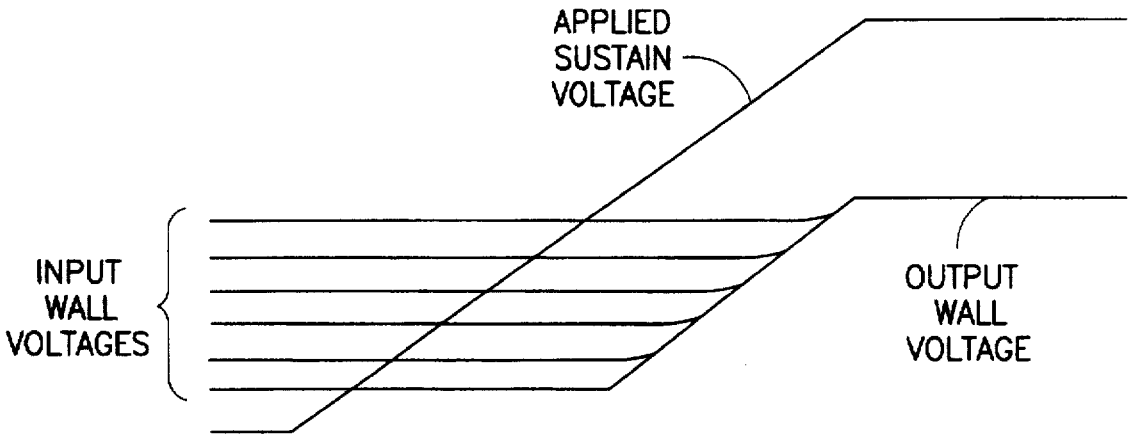
FIG. 8 is a plot of wall voltage output values, for different wall voltage input states, in response to a slowly ramped sustain pulse.

FIG. 8 is a plot of a plurality of different input wall voltages, illustrating how the output wall voltage responds to an applied sustain voltage. Note, given a slow rise time of the sustain voltage (such as that shown for curve d and e of FIG. 7), that many different input wall voltages result in a same value of output wall voltage. This shows, that as the sustain voltage waveform slowly rises, that some threshold voltage is reached where a weak discharge starts which causes the wall voltage to rise slowly. This discharge is very slow and is controlled entirely by the rate of rise of the sustain voltage. If the sustain voltage rises more slowly, then the discharge current adjusts to a lower level so that the wall voltage rises at the same slower rate as the sustain voltage. Since the wall voltage and the sustain voltage are rising at the same rate, it is evident that there is some fixed difference between the sustain voltage and the wall voltage, that difference being the voltage across the gas during the discharge. For such a slow ramp as indicated in FIG. 8, the constant voltage across the gas remains constant until the sustain voltage stops rising. The discharge current level is at such a low level that the wall voltage stops rising at almost the same time as the sustain voltage stops rising. Note that a more negative input voltage simply means that the discharge starts earlier on the ramp, but does not change the final fixed output voltage level.

An analysis of FIG. 8 indicates that the slowly ramping sustain voltage maintains the current through the discharging gas at a relatively constant level. This further indicates that the slowly ramping sustain voltage maintains the discharge in the positive resistance region of its discharge characteristic. If the ramp voltage rise time is too rapid, the current through the gas discharge will cause the conduction characteristic to enter the negative resistance region wherein a very rapid "avalanche" current flow is experienced.

Figure 9A:
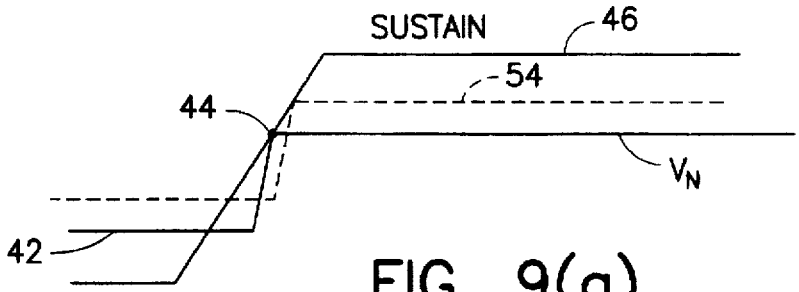
FIG. 9*a* is a plot of wall voltage output values, for different wall voltage input states, in response to a rapidly ramped sustain pulse.
Figure 9B:
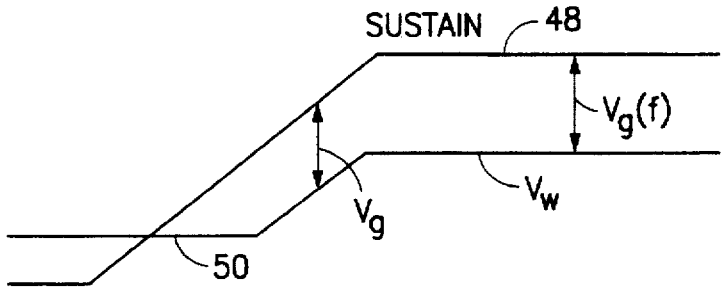
FIG. 9*b* is a plot of wall voltage output values, for a given wall voltage input state, in response to a slowly ramped sustain pulse, showing a substantially constant voltage drop across the gas during discharge.

It has been determined that the behavior shown in FIG. 8 only occurs if the rise time of the applied sustain wave form is sufficiently slow. If the rise time is too fast, such as shown in FIG. 9(*a*), an input wall voltage 42 experiences an abrupt rise. At such time, a collapse occurs in the voltage across the gas (illustrated by the intersection point 44 between input wall voltage curve 42 and sustain voltage wave form 46). At the point of collapse, there is no further increase in the wall voltage. By contrast, as shown in FIG. 9(*b*), if the sustain wave form 48 has a slowly rising ramp characteristic, the voltage across the gas (Vg)—which is the difference between the wall voltage characteristic 50 and sustain characteristic 48—remains substantially constant. At the termination of the sustain action, a final gas voltage Vg(f) still remains, thereby indicating that the discharge action has occurred within the positive resistance portion of the discharge characteristic of the gas.

Returning to FIG. 9(*a*)—dashed wall voltage waveform 54 illustrates the wide variation in wall voltage output which can occur if the discharge action is allowed to operate in the negative resistance region.

Figure 10:
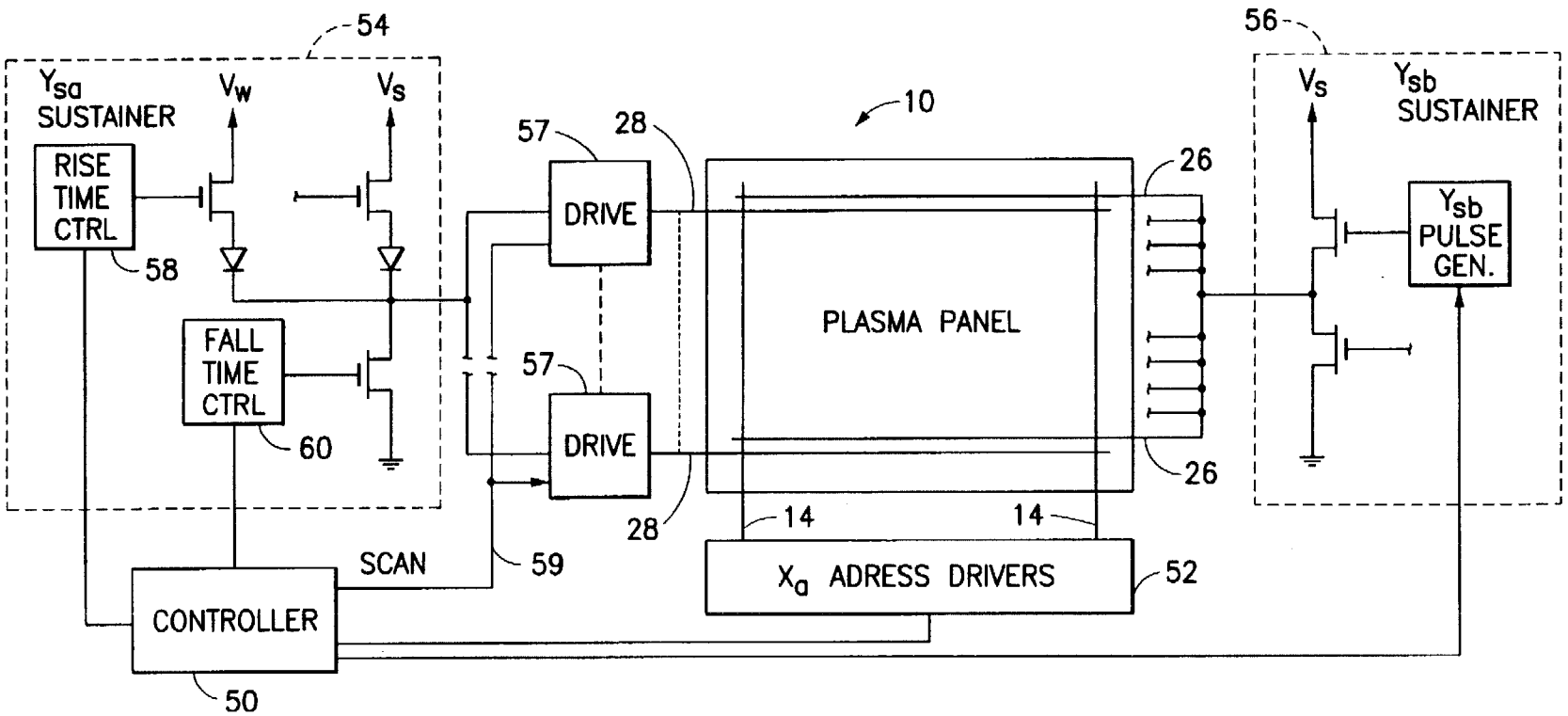
FIG. 10 is a circuit diagram of a plasma panel system incorporating the invention hereof.
Figure 11:
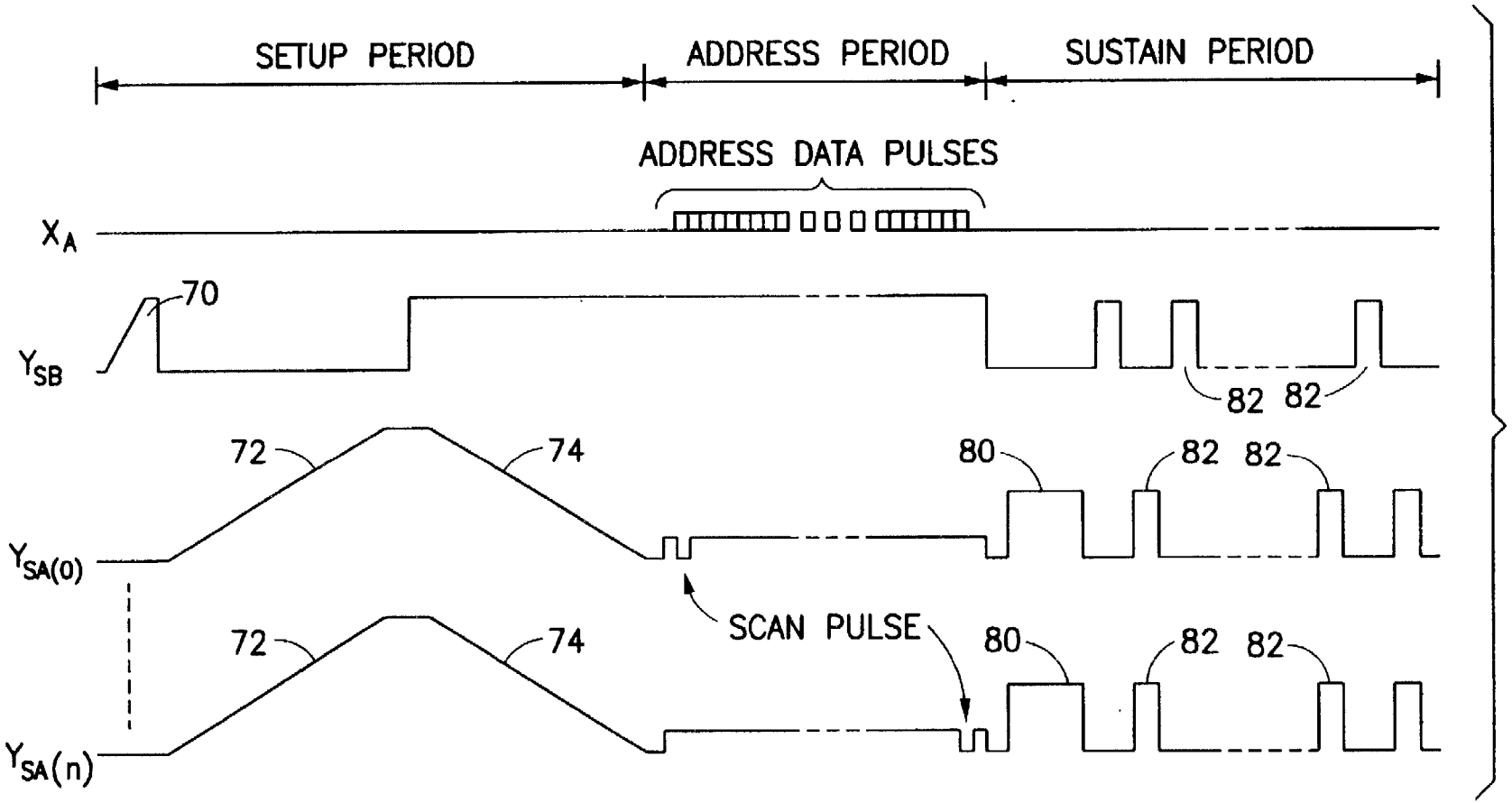
FIG. 11 is a set of waveforms helpful in understanding the operation of the system of FIG. 10.

Referring to FIG. 10, a block diagram is shown of a system for operating a plasma panel 10, utilizing slowly ramping sustain potentials during a set-up phase. The waveform diagrams of FIG. 11 are illustrative of the waveforms employed during the operation of FIG. 10. A controller 50 provides outputs to control a plurality of Xa address drivers 52 which provide selective addressing potentials to column electrodes 14. Controller 50 further provides control outputs to a Ysa sustainer module 54 and a Ysb sustainer module 56. Ysa sustainer module 54 is utilized to provide the waveforms required during the set-up period and the sustain period of FIG. 11. Ysb sustainer module 56 applies voltage outputs to sustain lines 26 in common and Ysa sustainer module 54 applies its outputs, via Y address drivers 57, in common to sustain lines 28. Controller 50, via scan line 59, causes Y address drivers 57 to sequentially apply address potentials to successive lines 28, during the address period shown in FIG. 11.

It is a primary function of Ysa sustainer module 54, during the set-up period, to apply a sustain waveform with a rise time and a fall time that are sufficiently slow so that controlled pixel site discharges are achieved. This enables the establishment of standardized wall voltages at each pixel site that are substantially independent of prior existing wall charge states. The slowly ramped sustain waveforms also provide sufficient priming for reliable address discharge operation of the addressed pixel sites. All of this operation occurs in a manner which generates a minimal amount of discharge light.

Initially, controller 50 causes Ysb sustainer module 56 to generate an erase pulse 70 (see FIG. 11) which is impressed on all sustain lines 26 and acts to erase any pixel sites which are in the ON state. This initial erase action has been previously taught by Criscimagna, et al. in U.S. Pat. No. 4,611,203. While erase pulse 70 manifests a ramped leading edge, the slope of that edge is not critical. The Criscimagna reference contains no teaching regarding any relationship between the leading edge ramp of the erase pulse and the positive resistance region of a pixel site's gas discharge characteristic.

After the initial erase action, controller 50 operates a rise time control circuit 58 within Ysa sustainer module 54 which, in turn, applies a slowly rising ramp potential 72 to all sustain lines 28 (see FIG. 11). As further shown in FIG. 12, slowly rising sustain pulse 72 eventually causes a discharge to commence within each of the pixel sites along sustain lines 28, but due to the slow rise time of sustain ramp 72, the current flow through the discharging gas remains in the positive resistance region of the gas discharge characteristic, thereby enabling a substantially constant voltage drop to be maintained across the gas.

At the end of the rising ramp of waveform 72, controller 50 then turns on a fall time control circuit 60 which causes a slowly decreasing ramp voltage 74 to be applied to all sustain lines 28. As a result, a further controlled discharge occurs along pixel sites associated with sustain lines 28, thereby causing the establishment of standardized wall potentials at each of the pixel sites along all sustain lines.

Midway during the set-up period, controller 50 causes the Ysb sustainer module 56 to apply a raised potential to all sustain lines 26. During the succeeding address pulse period, address data pulses are applied via Xa address drivers 52 to selected column address lines 14 while sustain lines 28 are scanned as indicated above. This action causes selective setting of the wall charge states at pixel sites along a row in accordance with applied data pulses.

Thereafter, during the following sustain period, controller 50 cause an initial longer sustain pulse 80 to applied by Ysa sustainer 54 to sustain line 28. Sustain pulse 80 enables an extra long discharge which assures that any priming problem is overcome by providing sufficient extra time to enable slowly discharging pixel sites to fully discharge. Thereafter, shorter duration sustain pulses 82 are applied to the Ysa and Ysb sustain lines in the manner taught by Yoshikawa, et al. to derive desired gray levels.

The waveforms shown in FIG. 11 allow a reduction in the voltage amplitudes of the address and scan pulses used during the address period and applied by address drivers 57 and Xa address drivers 52. This is a desirable characteristic because lower voltage address drivers are usually lower cost than higher voltage drivers.

Since the gas discharge characteristic shown in FIG. 5 has a very sharp threshold, a relatively small amplitude address pulse can be used to push the gas over this threshold and thereby cause a large change in output wall voltage which can be used to turn the pixel ON. Unfortunately, the characteristic threshold of discharges in a panel varies from sub-pixel to sub-pixel and therefore in order to use one set of applied address pulses for all pixels in the panel, a higher than minimum address pulse amplitude is usually necessary for reliable addressing. It is desired is to set-up the wall voltage for each sub-pixel site at the end of the set-up period so that each discharge site has its individual wall voltage set to be just below its individual threshold for discharge. In this way, a minimal amplitude Xa address pulse can be used to push all sub-pixel sites over the threshold and cause them to be written into the ON state.

Figure 12:
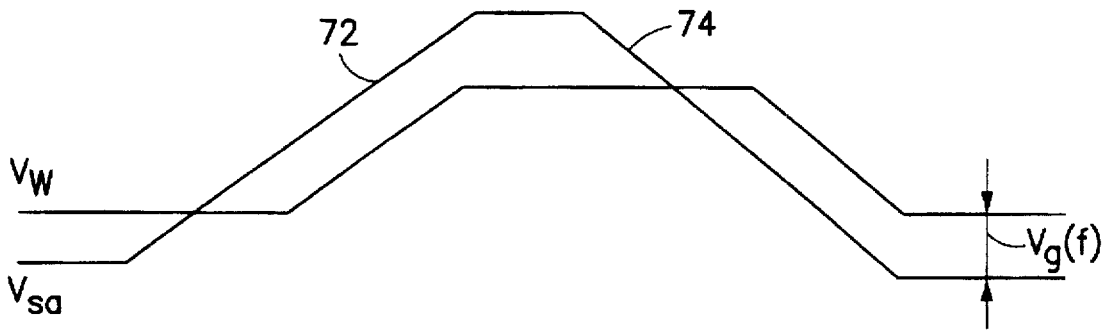
FIG. 12 illustrates wall voltage states which result from use of the set up waveforms of FIG. 11.

The waveforms, shown in FIG. 11 for the setup period, achieve this desirable set of characteristics. FIG. 9(*b*) shows that after the completion of the sustain voltage ramp 48, the wall voltage 50 is at a level which places a fixed final voltage across the gas Vg(f). This voltage Vg(f) is just slightly below the threshold for discharge. FIG.12 shows that the falling ramp 74 also sets up a Vg(f) which is slightly below the threshold for discharge. This Vg(f) is set up on a sub-pixel by sub-pixel basis, since the value of the Vg(f) for a given sub-pixel is determined by the characteristics of each individual discharge during falling ramp 74 in which each sub-pixel site is operated at a level just slightly above the threshold and in the positive resistance region of the discharge characteristic.

The FIG. 11 waveforms sets up each individual sub-pixel with its specific Vg(f) value which is for each sub-pixel case, just below the threshold for discharge. In this way, a minimal amplitude Xa address pulse can be used in the address period to reliably write all pixels into the ON state.

FIG. 11 further shows that the Ysb sustain pulse rises to a high level between the application of the rising ramp 72 and the falling ramp 74. The Ysb voltage remains at this high level during the address period. The Ysb voltage is set to this high level during the address period in order to apply the full normal amplitude sustain voltage between the Ysb and Ysa electrodes during the addressing write pulse. A discharge during the addressing write operation will tend to reduce the voltage across the gas to a near zero level which will cause the wall voltage to go to nearly the same level as the wall voltage for the ON state when the Ysb sustainer is at the high level. Ysb is held high during the falling ramp 74 in order to set up the specific Vg(f) with the Ysb voltage level at the exact same level as will be used during the write discharge. In this way, the critical voltage Vg(f) across the gas just below threshold that is set up during the set-up period remains during the address period.

The method of operation described above exhibits a number of desirable characteristics. First, the slow nature of the discharges causes the minimal amount of discharge activity necessary to cause establishment of standardized wall voltages and provides sufficient priming for a selective addressing operation to follow. This allows the dark room contrast ratio to be high because the light generated by the slow discharge is low and so the background glow of OFF pixels is low. Dark room contrast ratios higher than 200:1 have been achieved with this invention. By comparison, the technique described by Yoshikawa, et al. typically achieves dark room contrast ratios of 60:1, because of the very strong discharge activity associated with the fast rise time set-up period voltage pulses.

A further advantage is that the set-up wave forms shown in FIG. 11 automatically adjust the final wall voltage to a standardized value that is nearly the maximum of final voltage of across the gas that a given pixel can have without discharging. Note further (see FIG. 8) that various level input wall voltages are converted to a standardized wall voltage, substantially independent of the wall voltage input states.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An AC plasma panel comprising plural pixel sites, each site including a dischargeable gas, said pixel sites arranged in rows and columns, each pixel site comprising orthogonally oriented first and second intersecting electrodes, said plasma panel further comprising:

circuit means for applying drive signals to a plurality of said electrodes, each drive signal including at least one ramp voltage which causes a discharge of said gas at each pixel site along an associated electrode and further exhibits a voltage slope that is set to assure that current flow through each said pixel site remains in a positive resistance region of a discharge characteristic of said dischargeable gas, so as to create standardized wall voltages at each pixel site along each said electrode; and address means for applying data pulses to a plurality of said electrodes during an address period to enable selective discharge of said pixel sites in accord with said data pulses.

2. The AC plasma panel as recited in claim 1, wherein said drive signals are applied during a set-up period, an address period and a sustain period, each said drive signal applying to plural said first electrodes said at least one ramp voltage during said set-up period.

3. The AC plasma panel as recited in claim 2, wherein said drive signals include both a positive-going ramp voltage and a negative going ramp voltage, both ramp voltages causing a discharge of each pixel site along an associated electrode, and both ramp voltages further exhibiting a voltage slope that is set to assure that current flow through each said pixel site remains in a positive resistance region of a discharge characteristic of said dischargeable gas.

4. The plasma panel as recited in claim 3 wherein each of said second electrodes is covered by a phosphor coating, at least three different color phosphor coatings being employed on succeeding second electrodes.

5. A plasma panel as recited in claim 4 wherein each said first electrode is adjacent a third electrode, said circuit means applying to said third electrode, prior to application of a ramp voltage, an erase pulse which causes any pixel site in an ON state to revert to an OFF state.

6. The plasma panel as recited in claim 5 wherein said circuit means applies, subsequent to said address period, sustain pulses to cause continuing discharges of pixel sites that are placed in an ON state by said data pulses, a first said sustain pulse having a duration longer than succeeding sustain pulses to achieve a reliable first sustain action.

7. A plasma panel as recited in claim 3 wherein both said positive-going ramp voltage and negative-going ramp voltage exhibit voltage rates of change that are less than 10 volts per microsecond.

8. A method for operating a plasma panel to both provide standardized wall potentials at commencement of each scan of a pixel row and to exhibit a high contrast ratio, said plasma panel including pixel sites with a dischargeable gas between orthogonally oriented first and second intersecting electrodes, said method comprising the steps of:

a. applying drive signals to a plurality of said electrodes during at least a set up period, each drive signal applying during said set up period, at least one ramp voltage which causes discharge actions at each pixel site along an associated electrode, said at least one ramp voltage exhibiting a slope of applied voltage which assures that said discharge actions establish standardized wall voltages at each pixel site along each said electrode; and b. applying data pulses to a plurality of said electrodes to enable selective discharge of said pixel sites in accord with said data pulses.

9. The method as recited in claim 8, wherein applying step (a) applies both a positive going ramp voltage and a negative going ramp voltage, both ramp voltages causing discharge actions at each pixel site along an associated electrode, said both ramp voltages further exhibiting a slope of applied voltage which assures that said discharge actions establish standardized wall voltages at each pixel site along each said associated electrode.

10. The method as recited in claim 9, further comprising the step of:

initially applying an erase pulse to all pixel sites arrayed along said first electrodes, prior to applying either said positive going ramp voltage or said negative going ramp voltage.

11. The method as recited in claim 9 further comprising the step of:

c. applying sustain pulses to a line of pixel sites to which said data pulses have been applied, a first said sustain pulse exhibiting a longer duration of application than succeeding sustain pulses so as to assure reliable discharge of addressed pixel sites.

12. The method as recited in claim 9, wherein both said positive going ramp voltage and said negative going ramp voltage have sufficiently slow rise and fall times, respectively, to assure operation of said dischargeable gas within a positive resistance region of a characteristic thereof, thereby assuring low level light emissions upon discharge activity resulting therefrom.

* * * * *